US006862818B2

(12) United States Patent
Johnen et al.

(10) Patent No.: US 6,862,818 B2
(45) Date of Patent: Mar. 8, 2005

(54) OIL REMOVING DEVICE FOR CLEANING PIPES THAT ARE PRESENT IN THE FORM OF COILS

(75) Inventors: Willi Johnen, Roetgen (DE); Glynn Jones, Raeren (BE)

(73) Assignee: Otto Junker GmbH, Simmerath (DE)

( * ) Notice: Subject to any disclaimer, the term of this patent is extended or adjusted under 35 U.S.C. 154(b) by 0 days.

(21) Appl. No.: 10/416,760

(22) PCT Filed: Sep. 6, 2002

(86) PCT No.: PCT/DE02/03288

§ 371 (c)(1),
(2), (4) Date: May 14, 2003

(87) PCT Pub. No.: WO03/025250

PCT Pub. Date: Mar. 27, 2003

(65) Prior Publication Data

US 2004/0020071 A1 Feb. 5, 2004

(30) Foreign Application Priority Data

Sep. 10, 2001 (DE) ..... 101 44 509

(51) Int. Cl.[7] ..... F26B 7/00

(52) U.S. Cl. ..... 34/104; 34/437; 15/104.03; 15/104.05; 15/304; 432/75

(58) Field of Search ..... 34/104, 437, 218; 15/104.03, 104.05, 304; 432/2, 75

(56) References Cited

U.S. PATENT DOCUMENTS 5,603,167 A * 2/1997 Toyoda et al. ..... 34/104
5,784,803 A * 7/1998 Toyoda et al. ..... 34/437
6,648,633 B1 * 11/2003 Suchan et al. ..... 432/75

* cited by examiner

*Primary Examiner*—Jiping Lu
(74) *Attorney, Agent, or Firm*—Jordan and Hamburg LLP

(57) ABSTRACT

An oil removing device for cleaning pipes that are present in the form of coils in a furnace that accommodates and heats the pipes, with or without associated cooling zone, has a gas guiding device for feeding a scavenging gas to or removing it from the pipes. The gas guiding device is provided with connections for detachably and sealingly linking with a gas feed line and a gas discharge line. Ends of every pipe are separately connected to one and the same connecting head that has a gas inlet and a gas outlet opening the axially aligned therewith. The end of the gas feed line and the end of the gas discharge line are opposite each other and can be displaced along with the gas inlet opening and/or the gas outlet opening while sealingly connected.

10 Claims, 3 Drawing Sheets

OIL REMOVING DEVICE FOR CLEANING PIPES THAT ARE PRESENT IN THE FORM OF COILS

BACKGROUND

The present invention relates to an oil removal device for cleaning pipes provided in the form of coils, having a furnace which receives and heats the pipes, with or without an assigned cooling zone, and a gas guiding device for introducing and removing scavenging gas into the pipes and/or out of the pipes, the gas guiding device having means for detachable, tight connection to a gas supply line on one side and a gas removal line on the other side.

An oil removal device is known from European Patent Application 0659907 B 1. In the device described there, the coil is heated in a furnace chamber and a gas is introduced and removed via a gas supply line to clean the inside of a pipe. In this case, the connection to the ends of the pipe to be cleaned is produced via two couplings, which are each attached to a pull and push rod and are moved toward the corresponding counterparts independently from one another and at diametrically opposing sides of the furnace chamber. This connection device is connected to the pull and push rod via a universal joint, so that a gas-tight connection may be achieved even if the support stand of the coil is positioned slightly twisted in the furnace chamber and the connection ends of the connection device are not parallel to one another.

A great disadvantage of the device described results from the gas supply and gas removal connections, which are positioned separately from one another and are independent of one another. The tightness of these connections is determined by the contact pressure of the connection device. In the event of high contact pressure, there is therefore the danger that the support stand will be displaced or deformed by the mechanical forces introduced via the connection device, so that leaks may arise.

SUMMARY OF THE INVENTION

The problem of the present invention is to provide an oil removal device which allows simple and gas-tight connection of coils to a gas supply device.

This problem is solved according to the present invention for a device of the type initially described in that both ends of each pipe are separately connected to one and the same connection head, which has a gas inlet opening and a gas outlet opening aligned axially thereto, and the ends of the gas supply line and the gas removal line are movable opposite to one another and simultaneously have a sealed connection with the gas inlet opening and gas outlet opening.

Because the inlet opening is positioned opposite and axially aligned to the outlet opening and both openings are positioned lying near one another in one and the same connection head, the gas removal line is used as a holder for receiving mechanical pressure of the gas supply line, so that the gas removal line and the gas supply line clamp the connection head between them, so that slipping of the coil or the stand due to the mechanical forces of the gas supply and gas removal lines is therefore excluded.

The device according to the present invention may also be implemented so that the connection head is rigidly fixed or integrated in the stand which is used to receive coils lying on top of one another. Therefore, this connection head is positioned relative to a furnace chamber by positioning the stand and the stand is fixed in its relative position to the furnace chamber when the connection to the gas supply and gas removal lines is produced. Furthermore, a stand of this type may be furnished with multiple coils outside the furnace chamber and may subsequently be moved into the furnace chamber for treatment.

Furthermore, the device according to the present invention may be implemented so that the two ends of the coils are separately connected for gas supply and gas removal via pipelines connected to the stand, so that therefore a fixed connection between the connection head and a gas distribution system is provided.

Furthermore, the device according to the present invention may be implemented so that the two pipe ends of each coil are each connected via a flexible coupling to the pipeline which supplies and removes the gas. Therefore, the connection of a coil to the gas supply line and gas removal line is significantly simplified, since geometric tolerances of the external shape of the coil may be compensated for through the flexible couplings.

Furthermore, the device according to the present invention may be implemented so that at least the sections of the gas supply line and the gas removal line neighboring the connection head are mounted so they are movable aligned in a straight line until they press against the gas inlet opening and/or the gas outlet opening, and back. Therefore, the connection parts of the gas supply and gas removal lines adjoining the connection head must only perform a simple straight line movement in order to connect to the connection head.

Furthermore, the device according to the present invention may be implemented so that at least the sections of the gas supply line and gas removal line neighboring the connection head are movable along a curved path until they press against the gas inlet opening and/or the gas outlet opening, and back. The connection parts of the gas supply line and gas removal line adjoining the connection head must then only be moved along the curved path in order to produce a gas-tight connection to the connection head.

Furthermore, the device according to the present invention may be implemented so that the gas supply line and the gas removal line are pneumatically or hydraulically driven in their movement. The contact pressure of the connection parts on the connection head necessary for a gas-tight connection may thus be applied through the drive of the connection parts of the gas supply line and gas removal line.

Furthermore, the device according to the present invention may be implemented so that the sections of the gas supply line and the gas removal line neighboring the connection head are mounted pivotably to adjust for any tolerances as the gas line and connection head meet. In this way, the seal to the connection head in the furnace chamber may be made even more reliable.

Furthermore, the device according to the present invention may be implemented so that the sections of the gas supply line and the gas removal line neighboring the connection head are implemented as axially flexible. In this way, the tolerances arising in the axial direction during positioning of the connection head in the furnace chamber are compensated without the stand being displaced through the incident pressure.

Finally, the device according to the present invention may be implemented so that the pipeline for the gas to be removed has multiple channels which are separate from one another, which each communicate with the outlet of a pipe of a specific coil. Vice versa, the pipeline for the gas to be supplied may also have multiple channels which are separate from one another, which each communicate with an inlet of a pipe of a specific coil. This allows measurement and regulation of the gas flow through a specific coil.

In the following, an embodiment of the device according to the present invention is described on the basis of the drawings.

DETAILED DESCRIPTION

Figure 1:
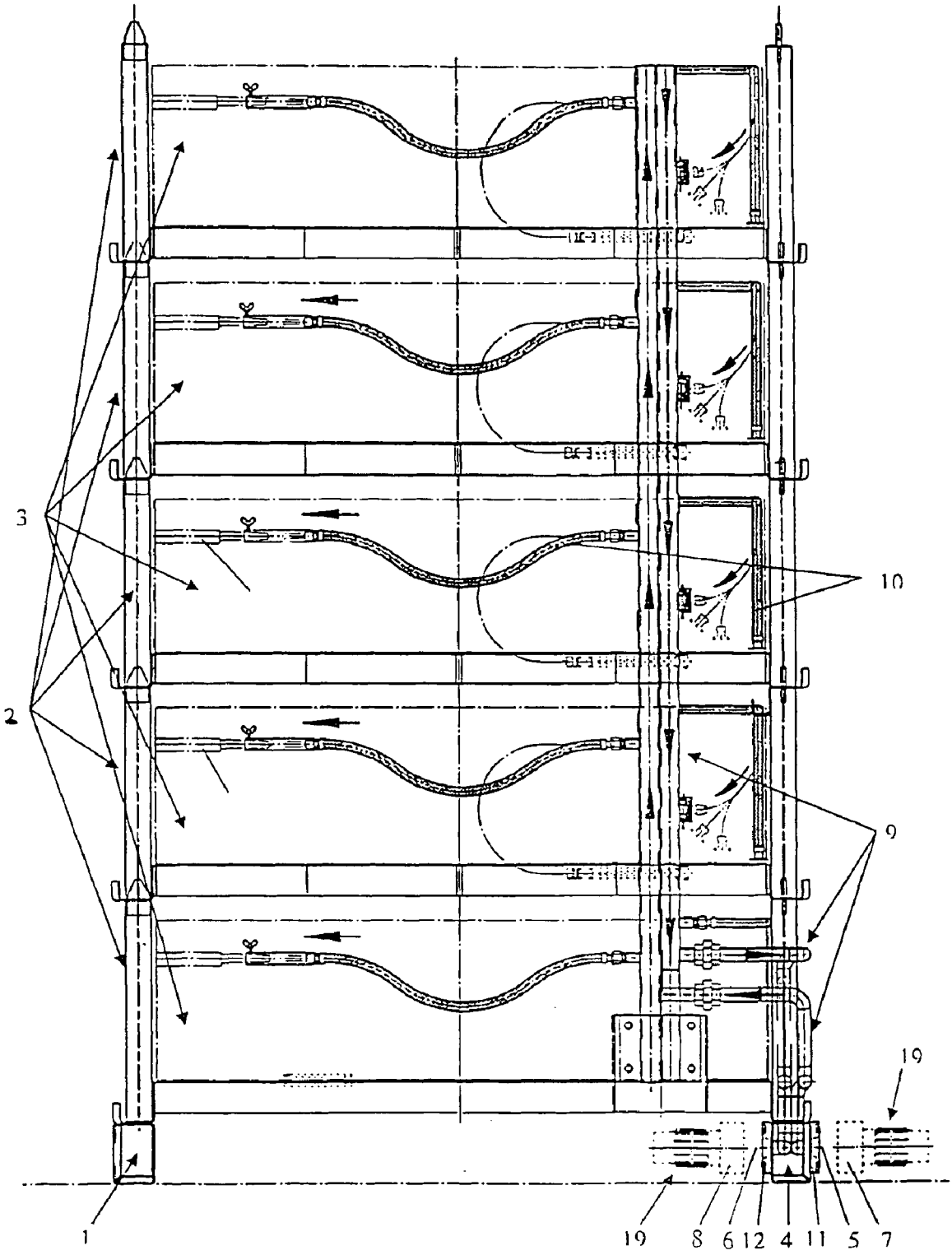
FIG. 1 shows a vertical section through a stand for receiving multiple coils having a connection head integrated into the stand.
Figure 2:
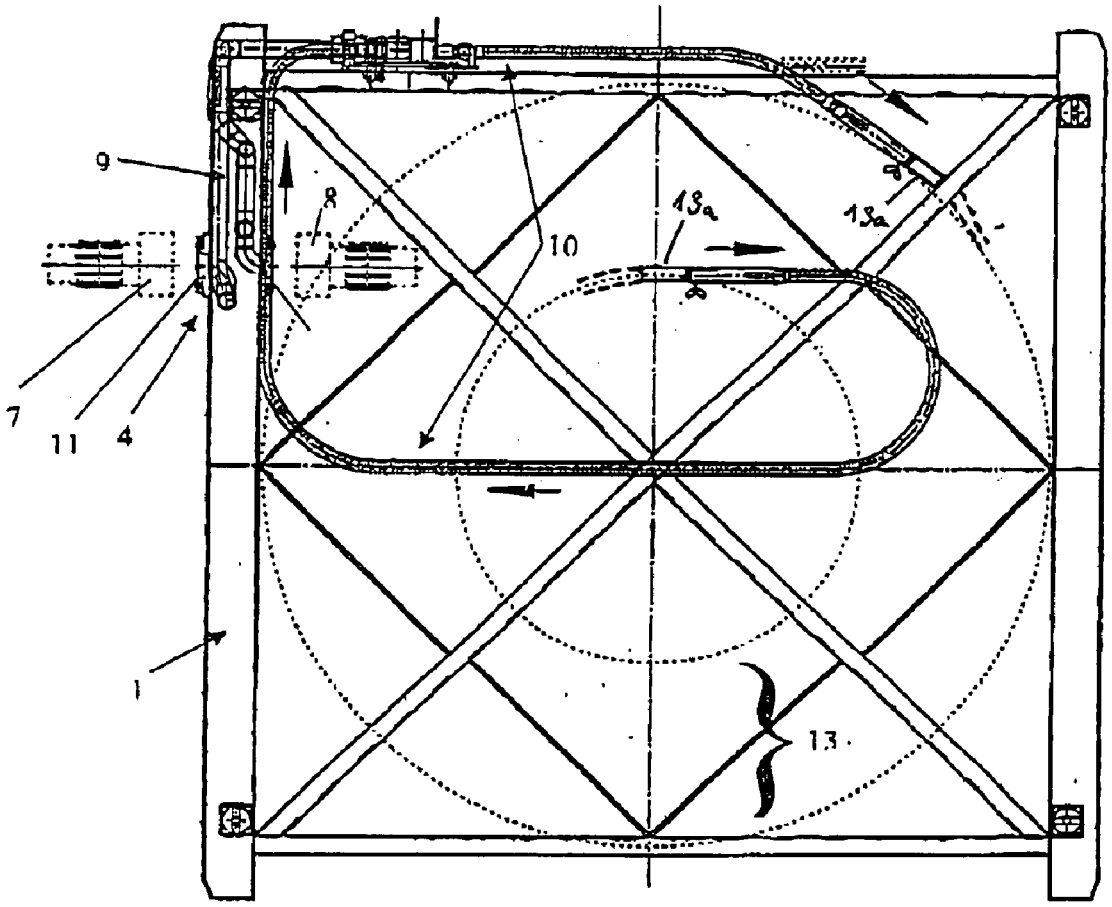
FIG. 2 shows a horizontal section through the stand having an integrated connection head.
Figure 3:
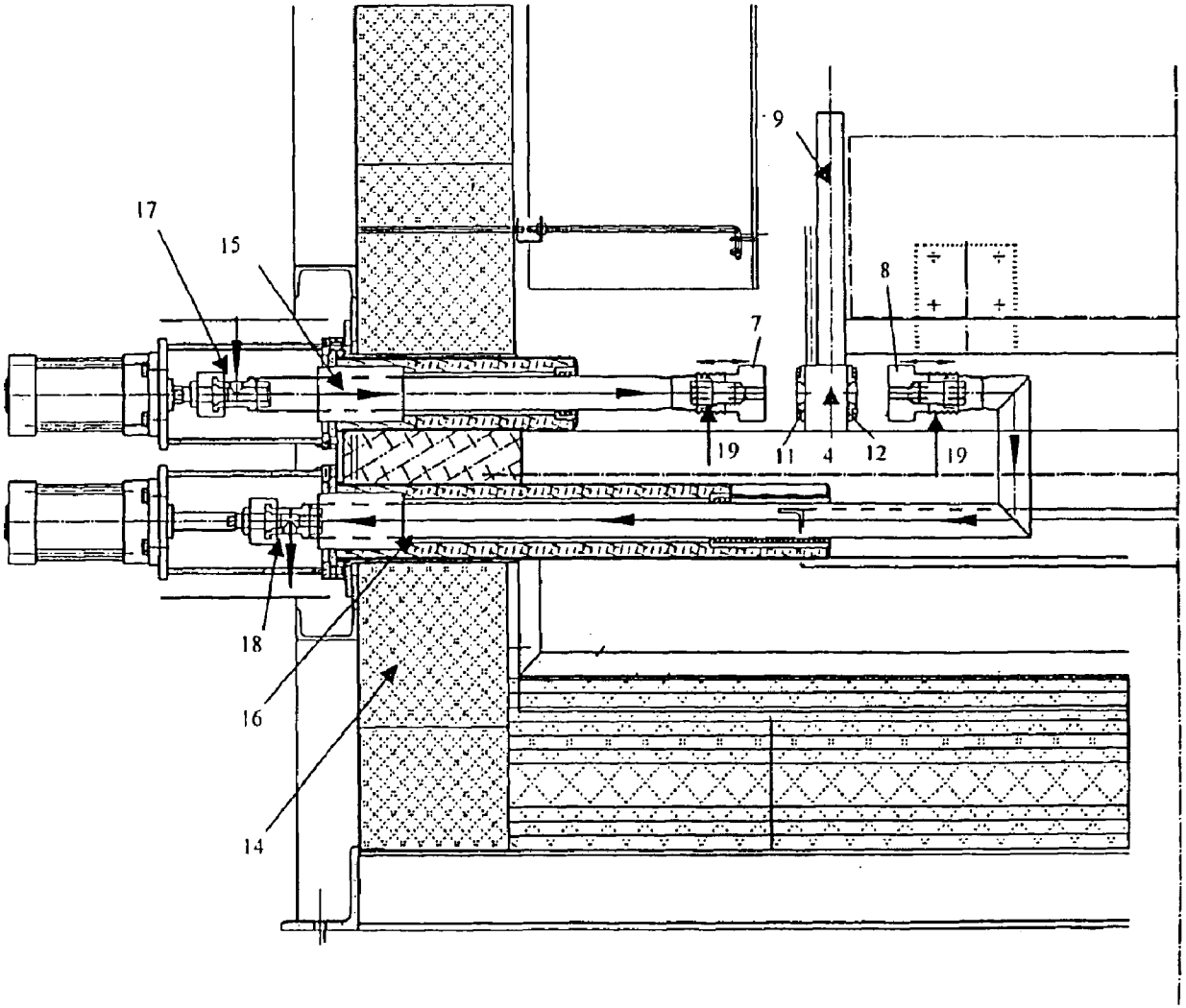
FIG. 3 shows a section through the furnace wall, the gas supply line and gas removal line, and the stand having an integrated connection head.

Referring to FIGS. 1–3, a stand 1 (FIG. 1) has attachments 2 positioned on top of one another, which each have a space 3 for receiving coils. A connection head 4 having a gas inlet opening 5 and an opposing gas outlet opening 6 is integrated into the stand 1. Ends 7 and 8 of the gas supply line 15 and gas removal line 16 connected to the connection head 4 are shown with dashes. The gas inlet opening 5 and gas outlet opening 6 are aligned axially and opposite to the openings 5, 6 of the connection head 4. It may be clearly seen that the openings of the connection parts 7, 8 of the gas supply line 15 and gas removal line 16 and the inlet and outlet openings 5, 6 of the connection head 4 are aligned on one axis, so that the connection parts 7, 8 are to be moved along the axis in order to produce a connection to the connection head 4. FIG. 2 shows a lower part of the stand 1, in which the connection head 4 is integrated in such a way that it comprises a connection part 11 provided for gas supply and a connection part 12 provided for gas removal. These connection parts 11 and 12 are fixed to the stand 1 and receive pipelines 9, also fixed to the stand 1, on the other side. Flexible couplings 10, which conduct the gas into a coil 13 (indicated with dashes), are connected to these pipelines 9. Furthermore, it may be seen that the openings of the connection parts 11, 12 and the openings of the connection parts 7, 8 of the gas supply line 15 and gas removal line 16 are aligned along one axis.

FIG. 3 shows a section through the furnace wall 14, through the gas supply line 15 and gas removal line 16 having the connection parts 7 and 8 attached thereto, and through the connection head 4 having the associated connection parts 11 and 12. The flow of the gas begins here with the supply 17 into the gas supply line 15. Subsequently, the gas is conducted through the connection parts 7 and 11 into the pipelines 9. From there, it is introduced into and removed from the coils and subsequently guided via the pipeline 9 and the connection part 12 into the gas removal line 16 until it is removed through the removal 18. As in FIGS. 1 and 2, it is clear here that the openings of the connection parts 7, 8 of the gas supply line 15 and gas removal line 16 are aligned with the openings of the connection parts 11, 12 of the connection head 4 along a shared axis, so that the gas supply line 15 and the gas removal line 16 are to be moved along this axis in order to achieve a gas-tight connection via the connection parts 7, 8, 11, and 12. The axial flexibility of the gas supply line 15 and gas removal line 16 necessary to compensate for tolerances, as well as the pivotable mounting of the connection parts 7, 8, are indicated by elements 19.

What is claimed is:

1. An oil removal device for cleaning pipes provided in the form of coils, having a furnace, which receives and heats the pipes, and a gas guiding device to introduce and remove scavenging gas into the pipes and from the pipes, the gas guiding device having means for detachable, tight connection to a gas supply line on one side and a gas removal line on an opposite side, the gas guiding device including a connection head having a gas inlet opening on the one side and a gas outlet opening on the opposite side axial aligned with the gas inlet opening, and an end of the gas supply line connected to the gas inlet opening and an end of the gas removal line connected to the gas outlet opening wherein the ends of the gas supply line and the gas removal line are directed opposite to one another and simultaneously movable with respect to the gas inlet opening and the gas outlet opening, and two pipe ends of each of the pipes are separately connected to one and the same connection head.

2. The device according to claim 1, wherein the connection head is integrated into a stand, movable relative to the furnace, for holding multiple coils positioned on top of one another.

3. The device according to claim 2, wherein the two pipe ends of each pipe are connected separately to the connection head for gas supply and gas removal via pipelines connected to the stand.

4. The device according to claim 3, wherein the two pipe ends of each pipe are each connected via a flexible coupling to the pipelines.

5. The device according to any one of claims 1 to 4, wherein at least the ends of the gas supply line and the gas removal line neighboring the connection head are mounted so they may be moved aligned in a straight line until they press against the gas inlet opening and the gas outlet opening.

6. The device according to any one of claims 1 to 4, wherein at least the ends of the gas supply line and the gas removal line neighboring the connection head are movable along a curved path until they press against the gas inlet opening and the gas outlet opening (6).

7. The device according to any one of claims 1 to 4, wherein the ends of the gas supply line and the gas removal line neighboring the connection head are mounted pivotably to adjust for any tolerance as the gas supply line and the connection head meet.

8. The device according to any one of claims 1 to 4, wherein the ends of the gas supply line and the gas removal line neighboring the connection head are implemented as axially flexible.

9. The device according to any one of claims 2 to 4, wherein the pipeline for the gas to be removed has multiple channels, which are separate from one another, which each communicate with a outlet of a pipe of a specific coil.

10. The device according to any one of claims 1 to 4, wherein the ends of the gas supply line and the gas removal line neighboring the connection head are one of hydraulically and pneumatically movable to connect with the connection head.

* * * * *